US006276237B1

(12) United States Patent
Stacy

(10) Patent No.: US 6,276,237 B1
(45) Date of Patent: Aug. 21, 2001

(54) COAXIAL SOCKET

(76) Inventor: Patrick Stacy, 2400 Industrial La., #700, Broomfield, CO (US) 80020

( * ) Notice: Subject to any disclaimer, the term of this patent is extended or adjusted under 35 U.S.C. 154(b) by 0 days.

(21) Appl. No.: 09/499,428

(22) Filed: Feb. 7, 2000

Related U.S. Application Data

(60) Provisional application No. 60/119,478, filed on Feb. 9, 1999.

(51) Int. Cl.[7] ..... B25B 9/00
(52) U.S. Cl. ..... 81/55; 81/13
(58) Field of Search ..... 81/13, 55, 58, 81/58.1, 121.1, 124.4, 124.5, 57.32, 77

(56) References Cited

U.S. PATENT DOCUMENTS

| | | | | |
|---|---|---|---|---|
| 1,507,362 | | 9/1924 | Bartosik . | |
| 1,509,258 | * | 9/1924 | Reiser | 81/55 |
| 1,734,270 | * | 11/1929 | Olson | 81/55 |
| 1,980,073 | * | 11/1934 | Melvin | 81/55 |
| 2,014,718 | | 9/1935 | Carington . | |
| 2,181,678 | * | 11/1939 | Wright | 81/55 |
| 2,267,012 | * | 12/1941 | Bowne | 81/55 |
| 2,752,809 | | 7/1956 | Lehmann . | |
| 2,772,590 | * | 12/1956 | Werries | 81/55 |
| 2,784,627 | | 3/1957 | Mueller et al. . | |
| 2,909,089 | | 10/1959 | Thompson et al. . | |
| 3,485,118 | | 12/1969 | Maughan, Jr. . | |
| 3,889,558 | | 6/1975 | Duncan . | |
| 4,923,412 | | 5/1990 | Morris . | |

* cited by examiner

*Primary Examiner*—Eileen P. Morgan
*Assistant Examiner*—Joni B. Danganan
(74) *Attorney, Agent, or Firm*—Ramon L. Pizarro; Edwin H. Crabtree

(57) ABSTRACT

A coaxial socket tool that includes an outer socket having a hollow body with a first end, a second end, and an inner diameter, the first end of the outer socket being adapted for engaging the surface of a nut of a size, the second end of the outer socket having a connector for transferring torque to the outer socket. An inner socket having a body is rotatably mounted within the inner diameter of the hollow body of the outer socket. The body of the inner socket has a first end and a second end. The first end of the inner socket is adapted for engaging a nut of the same size as engaged by the first end of the outer socket. The second end of the inner socket also having a connection that allows transfer of torque to the inner socket.

3 Claims, 2 Drawing Sheets

COAXIAL SOCKET

REFERENCE TO RELATED APPLICATIONS

This application claims the benefit of my provisional application having serial No. 60/119,478, filed Feb. 9, 1999, now abandoned.

BACKGROUND OF THE INVENTION (a) Field of the Invention

This invention generally relates to a tool for tightening a pair of in-line nuts or fasteners against one another. More particularly, but not by way of limitation, to a socket for tightening a pair of socket connectors on a coaxial cable.

(b) Discussion of Known Art

It has been discovered that many radio frequency signals can be effectively carried through coaxial cable. The connection of one section of coaxial cable to another section or to a device that uses the signal carried by the coaxial cable is frequently carried out with the use of a connector, such as the connector illustrated in U.S. Pat. No. 4,923,412, issued to William Morris on May 8, 1990, incorporated here, in its entirety, by reference. A serious problem encountered in the field while installing these connectors is that the connectors use two nuts of the same size that must be turned against one another. This problem of having to turn two nuts against one another along a single rigid bolt or fastener is often encountered on applications where two nuts are used to lock one another along the bolt. However, in applications where the bolt is rigid, and not mounted on somewhat delicate components, such as the insulating components of coaxial cable, the counter-torquing of the nuts presents few problems. A good mechanic simply uses two wrenches: placing one wrench on each nut, and then turning the wrenches towards one another. This method of tightening the nuts relative to one another can lead to damage to a coaxial cable. Therefore there remains a need for a tool that can be used to tighten two nuts on a coaxial cable, without imposing, or while minimizing the amount of bending imposed on the cable.

A review of known devices will disclose devices such as the invention taught in U.S. Pat. No. 2,752,809 to Lehmann which reveals that there are sockets which can be used to torque down a pair of nuts against each other, but these tools are solutions for applications where a nut of a diameter is being tightened over a nut of a larger diameter. This type of problem is relatively easily solved with a dual socket wrench such as the Lehmann wrench. Unfortunately, however, these known devices do little for the problem associated with tightening two nuts of the same size against one another while using a single socket.

Thus, U.S. Pat. Nos. 2,909,089 to Thompson et al., U.S. Pat. No. 2,784,627 to Mueller et al, U.S. Pat. No. 2,752,809 to Lehmann, U.S. Pat. No. 2,014,718 to Carrington, and U.S. Pat. No. 1,507,362 to Bartosik do little to suggest a solution of the problems associated with connectors for cables because they solve problems dealing with fasteners on relatively rigid supports, such as pipes, rigid bolts and so on.

Therefore, a review of known devices reveals that there remains a need for a simple device that can be used with a wrench, preferably a box, socket or similar type wrench handle to tighten couplings on the cable.

Still further, there remains a need for a simple, reliable socket type tool that can be used to safely tighten or loosen coaxial cable connectors or similar connectors.

SUMMARY

It has been discovered that the problems left unanswered by known art can be solved by providing a coaxial socket tool that includes:

a hollow outer socket with a first end that has been adapted for receiving and engaging a nut or other rotatable fastening coupling and a second end that includes a coupler for engaging a handle or other torquing mechanism;

a hollow inner socket that fits within the outer socket, the inner socket also includes a first end which has been adapted for receiving a nut or other rotatable fastening coupling, and a second end, which extends through the second end of the first socket and also includes a coupler for engaging a handle or other torquing mechanism.

The first end of the hollow inner socket as well as the first end of the outer socket will have a nut engagement mechanisms, in other words will have been adapted for receiving a nut or other rotatable fastening coupling, of the same size. This is because the coaxial cable connectors will typically include a male tip or connector and a female tip or connector which have similar, or functionally identical, external hexagonal nut profiles or other profiles found in other rotatable fastening mechanisms. Thus, it is important to note that as used herein, the word nut is intended to refer to a fastener having a threaded type engagement mechanism. Thus when referring to nut engagement, it is contemplated that a hexagonal, sharp pointed or multi protrusion or recess type fastener is also encompassed within the description.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
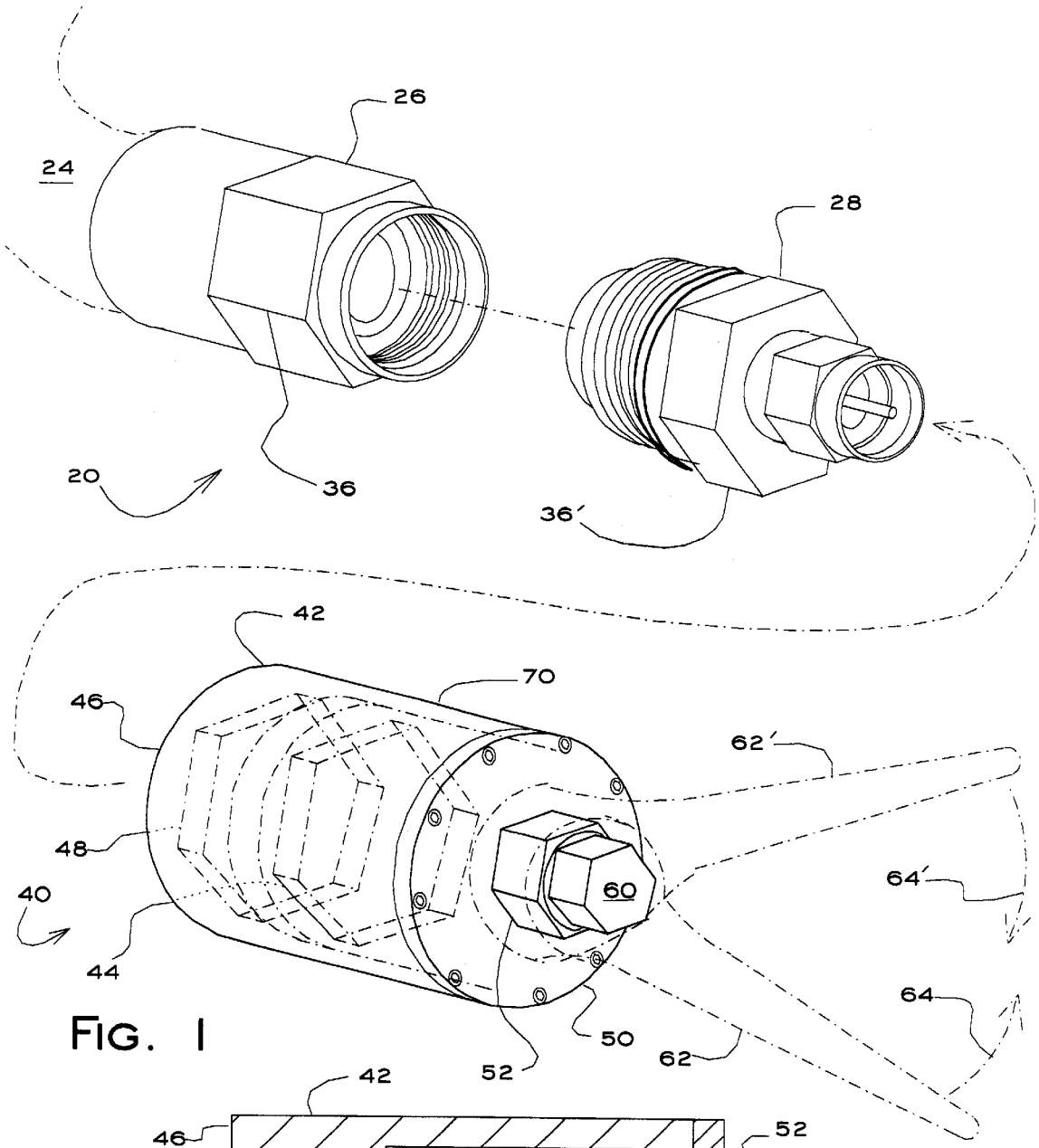
FIG. 1 illustrates the assembly of the connector and the use of the disclosed coaxial socket with a pair of wrenches (shown in phantom lines).
Figure 1A:
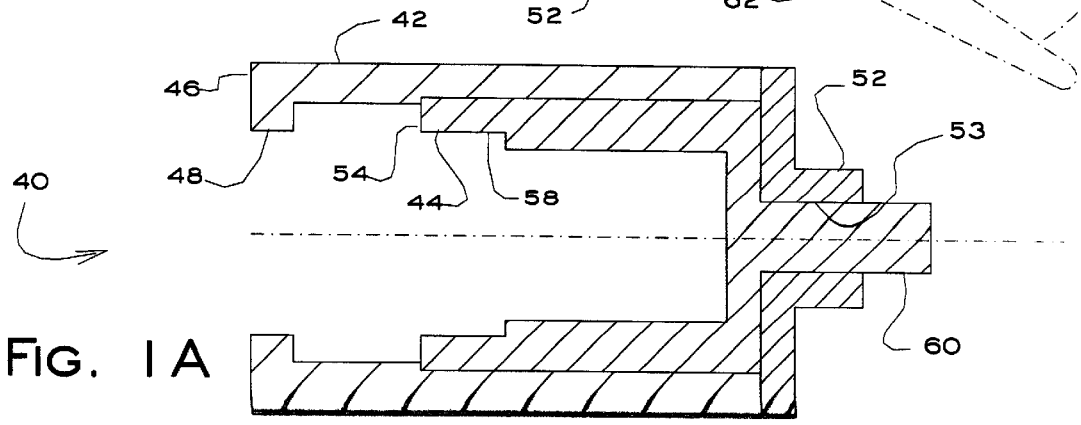
FIG. 1A is a section view of an assembled the coaxial socket.

Turning now to FIG. 1, where a coaxial socket 40 tool made in accordance with the principles taught herein has been illustrated. The coaxial socket 40 includes an outer socket 42 and an inner socket 44, which fits within the outer socket 42, and is free to rotate within the outer socket 42. Additionally, the outer socket 42 will include a first end 46 which includes a nut engagement means 48 and a second end 50 which includes a wrench engagement means 52 with an aperture 53 therethrough. It is important to note that the nut engagement means 48 has been sized to fit between the two nuts of the connector when tightened. This allows removal of the tool from the connector after tightening. Additionally, the inner socket 44 includes a first end 54 and a second end 56. The first end 54 includes a nut engagement means 58 and the second end includes a wrench engagement means 60. The wrench engagement means 60 is accessible through the wench engagement means 52 of the outer socket 42, and in a preferred embodiment will extend through the aperture 53 in the wrench engagement means 52 of the first socket.

The disclosed invention allows placement of two wenches or handles 62' at one end of the coaxial socket 40. The two wrenches or handles 62' may then be turned in opposing directions, as indicated by the arrows 64', to transfer torque to the connector 20 to turn the male tip 28 relative to the female tip 26 without having to turn or torque the female tip 26 against the cable 24. The nut engagement means 48 engage the outer surface (in this example the hex portion 36') of the female tip 26, while the nut engagement means 58 engages the outer surface (in this example the hex portion 36) of the male tip 28. Also, it is important to note that the disclosed coaxial socket may be used to tighten a female tip 26 against a male tip 28 where the external portions (such as the hex portions 36 of this example) are of different sizes or of similar sizes (such as in the disclosed example).

Figure 2:
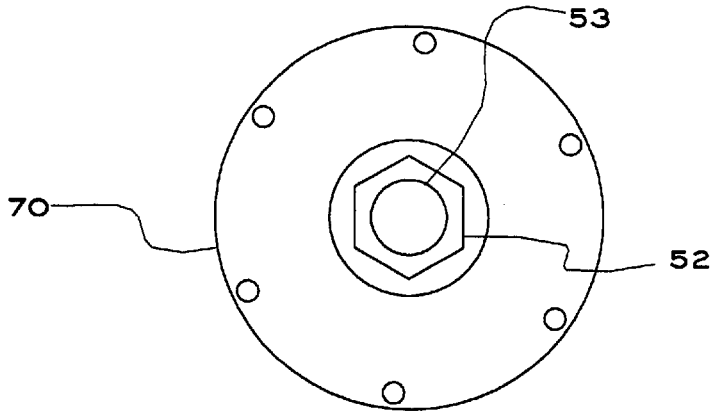
FIG. 2 is a detailed drawing of a preferred embodiment of the second end of the outer socket.

Turning now to FIG. 2 it will be understood that the second end 50 of the outer socket 42 is preferably defined by a cover 70 that is fastened or otherwise attached to the hollow body 72 of the outer socket 42. The view illustrates that the cover 70 incorporates the wrench engagement means 52 or mechanism for transferring torque to the body 72 of the outer socket 42.

Figure 3:
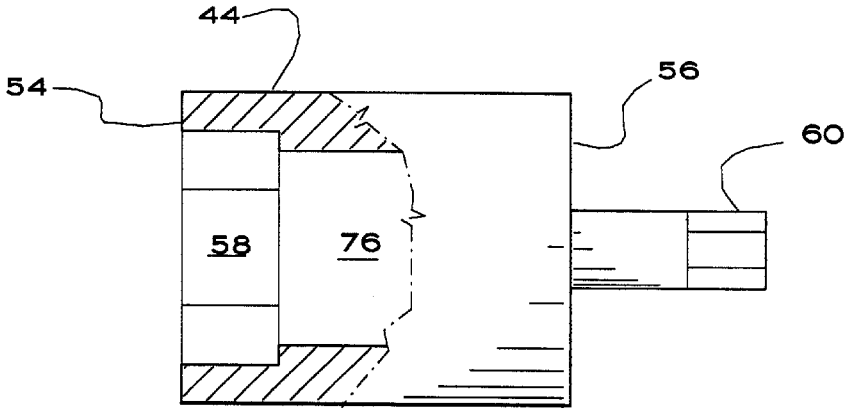
FIG. 3 is a detailed drawing of a preferred embodiment of the inner socket of a highly preferred embodiment of the invention.
Figure 4:
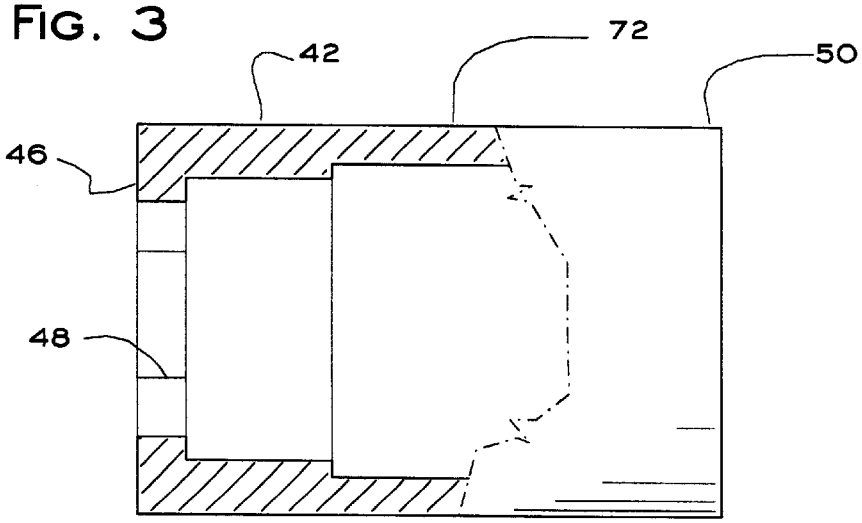
FIG. 4 is detailed drawing of a preferred embodiment of the outer socket of the instant invention.

As shown in FIG. 3, the inner socket 44 includes a body 74 with a cavity 76 that terminates near the second end 50 of the inner socket 44. The wrench engagement means 60 that is found on the second end 56 of the inner socket 44 will preferably extend s through the cover 70, and through the wrench engagement mechanism 52 on the cover 70.

In operation, for tightening a set connector, such as the connector 20, where a male tip 28 is to be torqued against a female tip 26, and where the user wishes to minimize the bending of the connection between the female tip 26 and the cable 24, the user would simply start the male tip 28 into the female tip 26. When the male tip 28 reaches the bottom of the female tip 26, requiring increased torque of the male portion against the female portion, the user would simply insert the coaxial socket 40 over the male tip 28 and the female tip 26. Once both the male tip 28 and the female tip 26 are both within the coaxial socket 40, a handle, wrench or other means for torquing the engagement means 60 relative to the engagement means 52 is connected to the coaxial socket 40 and the male portion 28 is tightened against the female portion. The tightening is carried out by the engagement of the outer socket 42, through the engagement means 48, of the female portion, and the engagement of the male tip 28 through the engagement means 58 on the inner socket, so that the male portion may be turned relative to the female portion.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A coaxial socket tool comprising:

an outer socket having a hollow body with a first end and a second end and an inner diameter, the first end of the outer socket having an aperture adapted for engaging a nut of a size, the inner diameter of the outer socket being larger than the aperture adapted for engaging a nut of a size, the second end of the outer socket having means for transferring torque to the outer socket;

an inner socket having a body adapted for housing within the inner diameter of the hollow body of the outer socket, the body of the inner socket having a first end and a second end, the first end of the inner socket being adapted for engaging a nut of the same size as engaged by the means for engaging a nut of a size of the outer socket the second end of the inner socket having means for transferring torque to the inner socket.

2. A coaxial socket tool comprising:

an outer socket having a hollow body with a first end and a second end and an inner diameter, the first end of the outer socket having an aperture adapted for engaging a nut of a size, the inner diameter of the outer socket being bigger than the aperture adapted for engaging a nut of the outer socket, the second end of the outer socket having means for transferring torque to the outer socket;

an inner socket having a body, the inner body being rotatably supported within the hollow body of the outer socket, the body of the inner socket having a first end and a second end, the first end of the inner socket being adapted for engaging a nut of the same size as engaged by the means for engaging a nut of a size of the outer socket the second end of the inner socket having means for transferring torque to the inner socket.

3. A method for turning a pair of mating threaded connector components of a coaxial connector, each of the connector components including an external engagement profile of a size, the size of the external engagement profile of both mating threaded connectors being the same, the method comprising:

providing a socket tool comprising:

an outer socket having a hollow body with a first end and a second end and an inner diameter, the first end of the outer socket having an aperture adapted for engaging the external engagement profile of the connector components, the inner diameter of the outer socket being bigger than the aperture adapted the external engagement profile of the connector components of the outer socket, the second end of the outer socket having means for transferring torque to the outer socket;

an inner socket having a body adapted for insertion within the inner diameter of the hollow body of the outer socket, the body of the inner socket having a first end and a second end, the first end of the inner socket having an aperture adapted for engaging a nut of the same size as engaged by the means for engaging a nut of a size of the outer socket the second end of the inner socket having means for transferring torque to the inner socket;

inserting both mating threaded connector components into the socket tool; and turning one mating threaded connector component against the other mating threaded connector component by turning the means for transferring torque to the inner socket relative to the means for transferring torque to the outer socket.

* * * * *